US006381781B1

(12) United States Patent
Bourgraf et al.

(10) Patent No.: US 6,381,781 B1
(45) Date of Patent: May 7, 2002

(54) COMBINATION AMBULANCE COT AND CHAIR

(75) Inventors: Elroy Edwin Bourgraf, Cincinnati; Ronald Duane Vance, Sabina; Eugene VanDyne, Wilmington, all of OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 09/613,399

(22) Filed: Jul. 11, 2000

Related U.S. Application Data

(60) Provisional application No. 60/150,466, filed on Aug. 24, 1999.

(51) Int. Cl.[7] ..... A61G 1/02

(52) U.S. Cl. ..... 5/618; 5/626; 5/627; 5/625; 296/20

(58) Field of Search ..... 5/618, 619, 620, 5/625, 626, 627, 86.1; 296/20

(56) References Cited

U.S. PATENT DOCUMENTS

| | | | | |
|---|---|---|---|---|
| 3,122,758 A | | 3/1964 | Ferneau | |
| 3,137,511 A | | 6/1964 | Weil et al. | |
| 3,289,219 A | * | 12/1966 | Ferneau et al. | 5/626 |
| 3,380,085 A | | 4/1968 | Ferneau et al. | |
| 4,105,242 A | | 8/1978 | Terbeek | |
| 4,688,279 A | | 8/1987 | Vance | |
| 4,949,410 A | | 8/1990 | Failor et al. | |
| 5,022,105 A | | 6/1991 | Catoe | |

FOREIGN PATENT DOCUMENTS

| | | |
|---|---|---|
| DE | 37 30 669 A1 | 3/1989 |

* cited by examiner

*Primary Examiner*—Lynne H. Browne
*Assistant Examiner*—Fredrick Conley
(74) *Attorney, Agent, or Firm*—Killworth, Gottman, Hagan & Schaeff, L.L.P.

(57) ABSTRACT

A reclinable ambulance cot used to load a patient into the back of an ambulance is provided. The cot includes a wheeled collapsible undercarriage carrying an articulated bed frame comprised of a leg segment, seat segment, and wheeled back segment. The articulated bed frame may be moved between an inclined, fully-reclined position, a chair position, and a plurality of positions therebetween. A lockable biasing device assists in the transition by urging the bed frame segments from the chair position to the fully-reclined position. The back segment further includes a pair of loading wheels at the ends of side extensions such that when the cot is in the inclined, fully-reclined position the loading wheels are at height sufficient to facilitate loading the reclined cot into the back of an ambulance, and in particular, into the back of an ambulance having a high transport deck.

9 Claims, 3 Drawing Sheets

COMBINATION AMBULANCE COT AND CHAIR

CROSS-REFERENCE TO RELATED APPLICATION

This application claims the benefit of U.S. Provisional Application No. 60/150,466, filed Aug. 24, 1999, which is incorporated by reference.

BACKGROUND OF THE INVENTION

The present invention relates to reclinable ambulance cots used to load patients into the back of an ambulance. More particularly, the present invention relates to a reclinable ambulance cot used to load a patient into the back of an ambulance, wherein situating the cot into a fully-reclined position elevates a loading end of the cot to a height which facilitates the loading of the reclined cot and a patient situated thereon into the ambulance.

In transporting emergency patients from their homes to a hospital for treatment, it is oftentimes necessary to remove the patient from his home using an ambulance cot, such as a stretcher, or the like, wherein the patient is situated thereon in a generally supine position. As well known in the art, such cots are typically provided with an undercarriage having a rollable base which facilitates transportation of the patient situated upon the cot to an ambulance parked near the patient's home. The undercarriage may be collapsed, thereby permitting the cot, its undercarriage, and the patient situated thereon to be rolled into the back of the ambulance in a fully-reclined position for transportation to the hospital.

However, in removing the patient from his home, it is sometimes difficult for paramedics to reach the patient with a fully-reclined cot, such as those of the prior art. Particularly, it is difficult for paramedics to traverse stairs to/from a second floor of the patient's home with a fully-reclined cot, or where the patient's home includes narrow hallways and doorways, through which maneuvering of a fully-reclined cot is extremely difficult, and sometime, impossible. In such situations, it is desirable for the cot to have a reduced "footprint," such as that provided by a wheelchair or the like, to facilitate maneuvering of the cot and of a patient situated thereon through the patient's home. Once the cot has been removed to a location free from any obstructions of the patient's home, such as, to a location near the back of the ambulance, it is desirable for the cot to be fully-reclinable to facilitate rolling the cot into the back of an ambulance.

Accordingly, there is a need to provide a reclinable ambulance cot which is movable between a fully-reclined position, where a patient situated thereon is resting in a generally supine position, and a chair position, where a patient situated thereon is in a generally upright, sitting position. U.S. Pat. No. 3,289,219 to Ferneau, et al. is illustrative of attempts made in the prior art to provide a combined ambulance cot and rolling chair which is movable between a reclined position and a chair position.

However, it has been observed that prior art reclinable ambulance cots do not provide an elevated loading end which is sufficient in height to facilitate rolling of the fully-reclined cot into the back of the ambulance, and more particularly, into the back of an ambulance which has a high transport deck in excess of 30 inches above the ground. With such prior art cots it is oftentimes necessary for one paramedic to lift the loading end of the fully-reclined cot to an elevation sufficient to permit rolling of the cot into the back of the ambulance while another paramedic pushes the cot into the back of the ambulance. It should be appreciated by those of reasonable skill in the art that loading a patient situated upon a fully-reclined cot into the back of an ambulance in this prior-art manner is difficult, for example, for the paramedics lifting the cot. Furthermore, such lifting increases the risk of physical injury to both the carried patient and the lifting paramedics.

Accordingly, there is also a need to provide a reclinable ambulance cot which is movable between a chair position and a fully-reclined position in which a loading end of the fully-reclined cot is elevated to a height that permits rolling of the reclined cot into the back of an ambulance, and in particularly, into the back of an ambulance with a high deck without the need for additional lifting of the cot by paramedics.

Moreover, it has been observed that prior art reclinable ambulance cots do not easily transition from the chair position to the fully-reclined position. Due to the typically provided ratcheting mechanism on such prior art cots, paramedics must pull up and then lower the cot into its reclined position. This lowering operation with these prior art cots is jarring which can add further discomfort to the patient.

Accordingly, there is also a need to provide a reclinable ambulance cot which transitions smoothly between the chair[]position and the fully-reclined position.

SUMMARY OF THE INVENTION

The above-mentioned needs are met by the present invention which provides a reclinable ambulance cot used to load a patient into the back of an ambulance. The cot of the present invention is movable between a fully-reclined position, wherein a patient situated thereon is in a generally supine position, and a chair position, wherein the patient situated thereon is generally upright in a seated position thereby providing a cot with a reduced footprint.

Additionally, the cot of the present invention includes a folding undercarriage pivotally mounting a support frame to a roller base. A segmented bed frame is adjustably connected to the support frame and includes a back segment, a leg segment, and seat segment. Included to back segment is a spacing bracket pivotably connected at one end thereof to the undercarriage and pivotably connected at another end thereof to the support frame. The leg segment is pivotably connected to the support frame, and provides a raisable footrest panel and a raisable footrest that may be used additionally as a pull handle. The seat segment is connected to the back segment and includes a linkage assembly that is connected to the leg segment. Accordingly, with the bed frame segments interconnected as such, moving the cot from the chair position to the fully-reclined position effect's vertical lifting of the back segment, thereby elevating a wheeled free loading end thereof to a height sufficient to facilitate loading the fully-reclined cot into the back of an ambulance, and more particularly, into the back of an ambulance having a high transport deck.

Furthermore, the back segment of the cot of the present invention includes an inclinable backrest frame that is pivotably connected at one end thereof to the support frame. The inclinable backrest frame is connected at another end thereof to a cross member spanning the width of the cot by a lockable extending member, preferably a gas spring. A second lockable extending member, also preferably a gas spring, is mounted within the linkage assembly of the seat segment. Accordingly, with these lockable extending members assisting in the transition of the cot between the chair position and the full-reclined position jarring of the cot is prevented. Moreover, these lockable extending members permit the cot of the present invention to be secured into an infinite number of positions between the chair position and the fully-reclined position thereby adding further to the comfort of the patient.

In one aspect, the present invention is a reclinable ambulance cot comprising a three-sided rectangular support frame, a roller base, and four legs pivotally mounted to the support frame and the roller base such that the legs may swing the roller base generally parallel to the support frame. Additionally, a pair of diagonal braces is pivotally mounted to the support frame and the roller base to releasably secure the legs perpendicular to the support frame. An articulated bed frame having a wheeled back segment is pivotally mounted to the support frame for movement at least between a chair position and a fully-reclined position in which the wheeled back segment is elevated to a sufficient height to permit rolling of the reclined cot into the back of an ambulance with a high transport deck.

In another aspect, the present invention is a reclinable cot comprising a three-sided rectangular support frame, a roller base, and four downwardly extending legs each having upper and lower ends. The lower ends of the legs are pivotally mounted to the four corners of the roller base and the upper ends of the legs are pivotally mounted to the support frame such that the legs may swing generally parallel to the support. Additionally provided is a pair of diagonal braces to normally brace the legs perpendicular to the support frame. The braces each having upper and lower links connected by an over-center hinge in which the lower links are pivotally mounted to the roller base and the upper links are pivotally mounted to the support frame, and an articulated bed frame constituted by a leg segment, a seat segment, and a wheeled back segment linked to each other. The bed frame is pivotally mounted to the support frame for movement between a chair position, in which the seat segment is horizontal and the leg and the wheeled back segments are generally vertical, and a fully-reclined position, in which all panels are inclined. In the fully-reclined position the wheeled back segment is elevated to a sufficient height to permit rolling of the reclined cot into the back of an ambulance with a high transport deck.

These and additional objects, features and advantages of the present invention will become apparent to those reasonably skilled in the art from the description which follows, and may be realized by means of the instrumentalities and combinations particularly pointed out in the claims appended hereto.

BRIEF DESCRIPTION OF THE DRAWINGS

A better understanding of the present invention will be had upon reference to the following description in conjunction with the accompanying drawings in which like reference numerals represent like parts, and wherein.

DETAILED DESCRIPTION OF THE INVENTION

Figure 1:
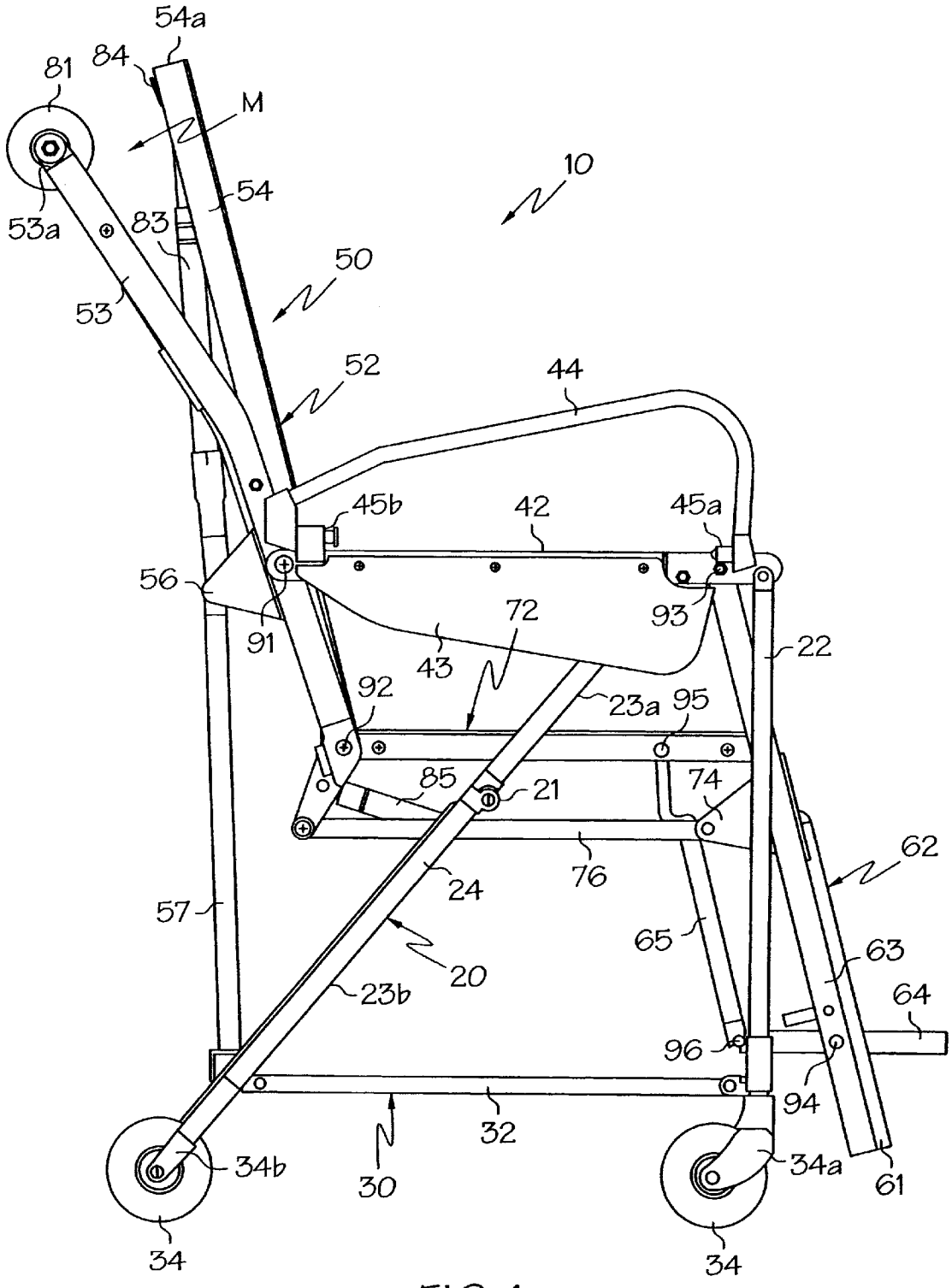
FIG. 1 is a side view of a reclinable ambulance cot according to a preferred embodiment of the present invention, showing the cot in a chair position.
Figure 2:
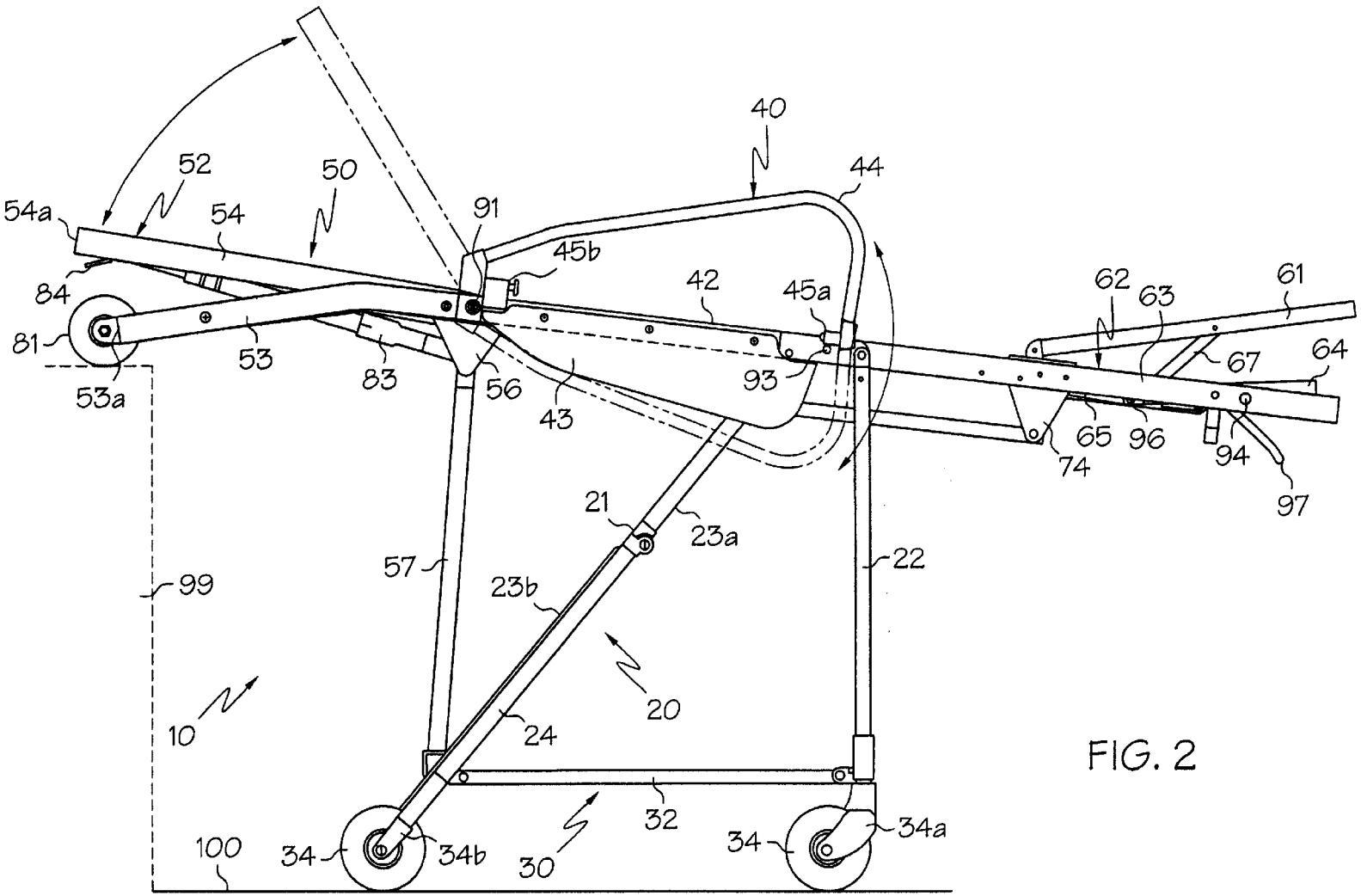
FIG. 2 is a side view of the reclinable ambulance cot of FIG. 1, showing the cot in a fully-reclined position; and, FIG. 3 is a rear view of the reclinable ambulance cot of FIG. 1, showing the cot in a chair position.
Figure 3:
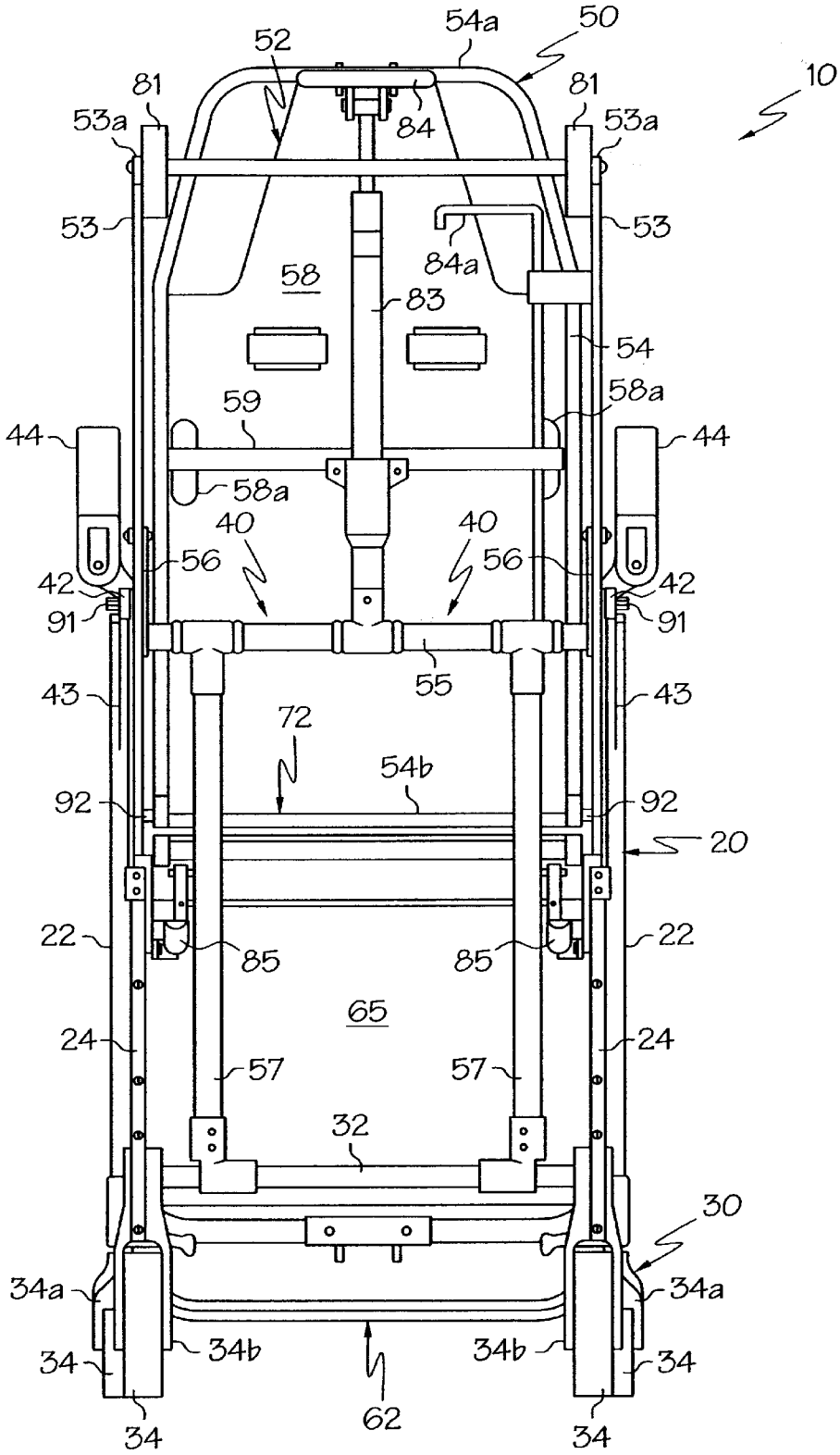

With reference to FIGS. 1–3, according to an embodiment of the present invention a reclinable ambulance cot 10 is shown. Preferably, both sides of the cot 10 are identical, and as such with reference to FIGS. 1 and 2, only one side of the cot 10 will be described herein. The reclinable ambulance cot 10 includes a collapsible undercarriage, generally indicated by 20, supportably connecting a roller base 30 to a support frame 40. Roller base 30 includes a generally rectangular frame having members 32, connected in an end-to-end fashion, and conventional wheels 34 rotatably mounted within brackets 34*a*, 34*b* to frame members 32 at their respective ends of intersection. Preferably, the front brackets 34*a* are rotatably mounted to frame members 32 to facilitate steering and maneuvering of cot 10, whereas the rear brackets 34*b* are fixedly mounted to frame members 32.

The support frame 40 is rectangular in shape with three sides having frame members and a fourth side open to permit patient loading. The support frame 40 is generally comprising a pair of base members 42, and cross member 55 (FIG. 3). Each of the pair of base members 42 may include a side shield 43 fixedly secured, such as, for example, by bolts, and an upright member 44 pivotably connected by fixed pin 45*a* and by locking pin 45*b*. It is to be appreciated that locking pin 45*b* is coaxial with fixed pin 45*a*. Upright member 44 pivots about the common axis of fixed pin 45*a* and locking pin 45*b* to move between an upward position, such as is shown in the FIGS. 1 and 2, wherein upright member 42 is generally coplanar with and extends upwardly from side shield 43, and a downward position as indicated by the dashed line in FIG. 2, wherein upright member 44 is positioned over side shield 43. Locking pin 45*b* is any conventional locking mechanism that is adapted to lock upright member 44 in either the upward position or the downward position. Alternatively, locking pin 45*b* may be adapted to lock upright member 44 in any angularly-offset position between the upward position and the downward position. Cross-member 55 is fixedly secured between a pair of side rail 53, and is offset therefrom by a preselected distance, such as, by brackets 56.

Undercarriage 20 includes two pairs of fixed-length legs 22, 57 pivotally mounted to the support frame 40 and the roller base 30 such that the legs 22, 57 may swing the roller base 30 generally parallel to the support frame. The first pair of fixed-length legs 22 pivotably connects a front end of roller base 30 to base member 42. The second pair of fixed-length legs 57 pivotably connect a rear end of roller base 30, preferably rear roller base member 32*a*, to cross-member 55. A pair of braces 24 is pivotally mounted diagonally to the support frame 40 and the roller base 30. The pair of braces 24 releasably secures the legs 22, 57 perpendicularly to the support frame 40. The pair of diagonal braces 24 normally brace the legs 22, 57 perpendicularly to the support frame 40, in which the braces 24 each have both upper and lower links 23*a* and 23*b*, respectively, connected by an over-center hinge 21. Since each lower link 23*b* is pivotally mounted to the roller base 30 and each upper link 23*a* is pivotally mounted to the support frame 40, breaking the over-center hinge 21 will permit the support frame to collapse along with roller base 30 into a retracted, compact orientation. A hand-operated level 97 is operatively connected to a conventional breaking mechanism (not shown) to facilitate the breaking or releasing of the braces 24 thereby permitting the roller base 30 to swing parallel to the support frame 40. One such conventional breaking mechanism is disclosed by U.S. Pat. No. 3,289,219 to Ferneau et al., which is herein incorporated by reference.

Cot 10 further includes an articulated bed frame, generally indicated by 50, which is adjustable between a chair position, such as shown in FIG. 1, and a fully-reclined position, such as shown in FIG. 2. Bed frame 50 comprises three main segments namely, a wheeled back segment 52, a leg segment 62 and a seat segment 72 operably connected to each other between the pair of base members 42. Back segment 52 includes the pair of side rails 53 which are pivotably connected to rear ends of the pair of base members 42, such as at first pivot point 91. As such, with the wheeled back segment 52, the seat segment 72, and the leg segment 62 operably connected to each other in this fashion, when the cot is in the chair position, the seat segment 72 is generally horizontal and both the leg segment 62 and the wheeled back segment 52 are generally vertical relative to the base 30. A wheel 81 is affixed to a free end 53*a* of each side rail 53, defining a loading end of the cot 10 thereof. The wheels 81 may be rotatably connected to one another, such as by axle 82 as shown in FIG. 3.

Back segment 52 further includes a frame-like backrest member 54 that is connected at a hinged end 54*b* (FIG. 3) thereof between the pair of side rails 53, such as at second pivot point 92. A first extending member or biasing spring 83 is connected at a first end to backrest member 54 adjacent a free end 54*a* thereof, and is connected at a second end to cross-member 55. Biasing spring 83 provides a positive, tensile biasing force when activated. For example, biasing spring 83 is preferably a gas spring having a lockable valve therein, such as the locking gas springs sold under the trademark BLOC-O-LIFT by Stabilus of Gastonia, N.C. Preferably, biasing spring 83 is a model 2482MM-C0275N 135/99 BLOC-O-LIFT brand gas spring manufactured by Stabilus providing a 275-newton tensile biasing force when the locking mechanism thereof has been released. Lock release 84 is connected to backrest member 54 such that, depressing release 84 releases the locking mechanism within biasing spring 83, thereby causing backrest member 54 to pivot about second pivot point 92 into an upright position shown with dashed line in FIG. 2 or any position therebetween shown by the arrow in FIG. 2 under the influence of the biasing force of spring 83. Once release 84 is released, the locking mechanism within biasing spring 83 prevents further extension thereof, thereby locking backrest member 54 in the upright position or any of an infinite number of positions therebetween. Moving backrest member 54 to the flat position as shown in FIG. 1 is accomplished by depressing release 84 and exerting a counter force against the biasing force of the biasing spring 83. Once the backrest member 54 is back in the flat position, releasing release 84 will lock the backrest panel in the flat position.

Leg segment 62 includes a pair of side members 63, and each connected at an upper end thereof to front ends of the pair of the base members 42, such as at third pivot points 93. A foot support panel 64 is positioned between the pair of side members 63, near respective lower ends thereof, and is pivotably connected thereto, such as at fourth pivot points 94. A secondary retractable footrest 61 pivotally mounted to the pair of side members 63 is also provided which can be elevated and secured in place by a pair of locking arms 67, illustrated in FIG. 2, to provide a footrest to a reclined patient and to act as a pull handle. The footrest 61 is stowed flush against the side members 63 as illustrated in FIG. 1.

Seat segment 72 is positioned between the pair of base members 42 and is pivotably connected at a rear end thereof to the hinged end 54*b* of backrest member 54, such as at second pivot points 92. A front end of the seat segment 72 is connected to a rear end of the foot support panel 64 of the leg segment 62 by a leg support panel 65, which is pivotably connected at a first end thereof to the seat segment 72, such as at fifth pivot point 95, and which is pivotably connected at a second end thereof to the rear end of the foot support panel 64, such as at sixth pivot point 96.

Each one of a pair of linkage brackets 74 is fixedly secured to its respective side member 63 of leg segment 62 and is connected to one of the pair of side rails 53 of back segment 52 by a respective linkage bar 76. More particularly, a first end of each linkage bar 76 is pivotably connected to its respective linkage bracket 74 and a second end of each linkage bar 76 is pivotably connected to its respective side rail 53. Accordingly, a four-bar linkage system is defined consisting of linkage bars 76, side members 63, base members 42 and side rails 53, having pivotably, pinned connections with one degree of relative movement between adjacent links.

Linkage bars 76 connect back segment 52 with leg segment 62 such that as back segment 52 is pivoted about first pivot point 92 in the direction shown generally as moment arrow "M" (FIG. 1), foot support panel 64, leg support panel 65, seat segment 72 and backrest member 54 move into a generally planar alignment or inclined, fully-reclined position as shown particularly in FIG. 2, such that a patient situated thereon assumes a generally supine position. It is to be appreciated that during this movement the brackets 56 pivot about cross- member 55 above legs 57 thereby effecting a vertical lifting of side rails 53. This vertical lifting of the side rails 53 above legs 57 raise the attached wheels 81 to an elevation sufficient to roll the loading end of the cot 10 onto a high transport deck, indicated by dashed line 99 in FIG. 2, of an ambulance. Accordingly, bracket 56 and legs 57 together extend wheels 81 at least 30 inches and more preferably, 33 inches above a loading surface 100.

Two lockable extending members or lift biasing springs 85 are each pivotably connected to, and thereby connect, one of the pair of linkage bars 76 with one of the pair of side rails 53. The pair of lift biasing springs 85 is constructed in a similar fashion as biasing spring 83 described above. It is to be appreciated that using the pair of lift biasing springs 85 reduces weight and part count while improving ergonomics and function. The use of lift biasing springs 85 allow infinite adjustment and part reduction over the prior art six-position ratchet bar style locking and positioning mechanisms, such as provided in U.S. Pat. No. 3,289,219 to Ferneau et al. Preferably, the pair of lift biasing springs 85 are model 6465KM0400N 103/98 gas springs manufactured by Stabilus under the trademark BLOC-O-LIFT, and provide up to 400 newtons of tensile biasing force when a locking mechanism provided therein is released. Release arm 84*a* is operatively connected to and activates release mechanisms within lift biasing springs 85, as described hereinabove with respect to springs 83. Lift biasing springs 85 assist relative movement of linkage bars 76 relative to side rails 53 to increase the angle therebetween, thereby smoothly urging the bed frame 50 from the chair position shown in FIG. 1 to the fully-reclined position shown in FIG. 2 or to any other infinite number of positions therebetween without jarring the patient carried thereon.

Backrest member 54 includes a substantially planar backrest panel 58 for supporting the patient situated thereon and a second cross-member 59 to support the backrest panel 58. Provided through panel 58 are one or more slotted, openings 58*a* near the cross-member 59, such that a restraining strap (not shown) used to restrain the patient against the cot 10 can pass through the opening 58*a*, front-to-back, and tied around the cross-member 59. As such, cross-member 59 is preferably spaced away from panel 58. Additionally, pillows, pads or cushions may be secured to foot support panel 64, foot support panel 65, seat segment 72 and backrest member 54, and any combination thereof, to provide a comfortable resting place upon which the patient is situated.

Although the present invention has been described in terms of a specific embodiment which is set forth in detail, it should be understood that this is by illustration only and that the present invention is not necessarily limited thereto, since alternative embodiments not described in detail herein will become apparent to those skilled in the art in view of the above description, the attached drawings and the appended claims. Accordingly, modifications are contemplated which can be made without departing from either the spirit or the scope of the present invention.

What is claimed is:

1. A reclinable ambulance cot suitable for rolling into the back of an ambulance with a transport deck in excess of about 30 inches above the ground, comprising:

a support frame having a pair of base members and a cross-member;

a roller base;

first and second pairs of legs, said first pair of legs each pivotally mounted to a respective one of said base members and said roller base, said second pair of legs pivotally mounted to said cross-member and said roller base, such that said legs may swing said roller base generally parallel to said support frame;

at least one diagonal brace pivotally mounted to said support frame and said roller base to releasably secure said legs perpendicular to said support frame; and an articulated bed frame pivotally mounted to said support frame for movement at least between a chair position and a fully-reclined position, said articulated bed frame having a wheeled back segment, wherein:

said wheeled back segment includes a pair of spaced apart brackets mounting said cross-member therebetween to lift said wheeled back segment above said second pair of legs in an inclined position such that said cot is elevated to a sufficient height to permit rolling of the reclined cot into the back of the ambulance.

2. A reclinable ambulance cot as claimed in claim 1 wherein said bed frame further comprises a leg segment and a seat segment, and said wheeled back segment, said seat segment, and said leg segment are operably connected to each other such that when said cot is in said chair position said seat segment is horizontal and both said leg segment and said wheeled back segment are generally vertical, and when said cot is in said fully-reclined position all said segments of said bed frame are generally planar and inclined.

3. A reclinable ambulance cot as claimed in claim 2 wherein said wheeled back segment further includes a backrest panel with a biasing spring for raising said backrest panel from a first substantially horizontal position to a plurality of raised positions.

4. A reclinable ambulance cot as claimed in claim 2 wherein said leg segment includes a pivotally mounted footrest panel that extends into a substantially horizontal position when said cot is in said chair position and retracts into a substantially flush position with said leg segment when said cot is in said fully-reclined position.

5. A reclinable ambulance cot as claimed in claimed 2 wherein said leg segment includes a pivotally mounted footrest that is movable between a retracted position that is substantially flush with said leg segment and an elevated position wherein said footrest is suitable as a pull handle.

6. A reclinable ambulance cot as claimed in claim 1 wherein said cot further comprises a pair of retractable armrests mounted to said support frame and wherein said armrests are movable between an upright position, a downward stowed position, and a plurality of positions therebetween.

7. A reclinable ambulance cot as claimed in claim 1 wherein said cot is provided with at least one extending member for assisting said cot between said chair position, said fully-reclined position, and a plurality of raised positions there between.

8. A reclinable ambulance cot as claimed in claim 7 wherein said cot further includes a release handle mounted to said wheeled back segment, wherein operating said release handle releases said at least one extending member allowing said cot to pivot from one position to another.

9. A reclinable ambulance cot suitable for rolling into the back of an ambulance with a transport deck in excess of about 30 inches above the ground, said cot comprising:

a support frame having a pair of base members and a cross-member;

a roller base;

first and second pairs of fixed-length legs, said first pair of fixed-length legs each pivotally mounted to a respective one of said base members and said roller base, said second pair of fixed-length legs pivotally mounted to said cross-member and said roller base, such that said legs may swing said roller base generally parallel to said support frame;

a pair of diagonal toggle braces each pivotally mounted to a respective one of said base members and said roller base to releasably secure said legs perpendicular to said support frame; and an articulated bed frame comprising a leg segment, a seat segment, and a wheeled back segment linked to each other, said bed frame is pivotally mounted to said support frame for movement at least between a chair position in which said seat segment is generally horizontal and said leg and wheeled back segments are generally vertical relative to the roller base, and a fully-reclined position in which said segments are in an inclined position, wherein:

said wheeled back segment includes a pair of spaced apart brackets mounting said cross-member therebetween to lift said wheeled back segment above said second pair of legs in the inclined position such that said cot is elevated to a sufficient height to permit rolling of the reclined cot into the back of the ambulance, and at least one extending member is coupled between said wheeled back segment and said leg segment for assisting said cot between said chair position, said fully-reclined position, and a plurality of raised positions there between.

* * * * *